US005613689A

United States Patent [19]

Gunday

[11] Patent Number: 5,613,689

[45] Date of Patent: Mar. 25, 1997

[54] BEACH GAME

[76] Inventor: Erhan Gunday, 2938 Holly Rd., Santa Barbara, Calif. 93105

[21] Appl. No.: 669,882

[22] Filed: Jun. 21, 1996

[51] Int. Cl.[6] ..... A63B 67/00

[52] U.S. Cl. ..... 273/440

[58] Field of Search ..... 273/440, 329, 273/282.1, 459

[56] References Cited

U.S. PATENT DOCUMENTS

| | | | |
|---|---|---|---|
| 1,628,073 | 5/1927 | Sousa | 273/282.1 X |
| 4,743,030 | 5/1988 | Auer et al. | 273/349 |

*Primary Examiner*—Paul E. Shapiro
*Attorney, Agent, or Firm*—Kenyon & Kenyon

[57] ABSTRACT

A beach game includes markers for planting into the sand and water indicator bands which change color upon becoming wet. A player attaches a water indicator band to his ankle or other body part and pursues retreating waves in the direction of the water. The player plants the marker into the wet sand as far out as possible, without wetting the water indicator, and then returns back up the beach in front of the resurging surf. The object of the game is to plant the marker further out than the other players without wetting the water indicator. The game is particularly advantageous for young children because the players necessarily avoid significant contact with water.

19 Claims, 2 Drawing Sheets

BEACH GAME

BACKGROUND OF THE INVENTION

1. Field of the Invention

The invention generally relates to sports which can be played on a beach adjacent to a body of water having a surf. More particularly, the invention relates to a game which can be played on a beach having some surf, wherein the object of the game is for a player to chase waves as far out as possible and then retreat back up the beach before getting wet.

2. Description of Related Art

Playing sports along ocean and lake beaches is a popular recreational pastime which has the advantage of promoting good health through outdoor exercise. Common beach games include volleyball, socker and jogging. In addition, water sports played near the coast are also quite common, such as surfing and paddle boarding.

Although these activities are excellent forms of exercise for adults, they may not necessarily be suitable for young children. This is particularly true in the case of water sports like surfing and paddle boarding for young children that are unable to swim. It is well known that a strong undertow can easily consume even an experienced surfer, and therefore there is a considerable risk of drowning by persons who cannot swim or who do not swim very well, particularly young children. Nevertheless, young children have a particularly strong attraction to the water which can create uneasiness and tension in their parents or adult companions.

Therefore, there is a need for a game which can be played by both young children and adults which necessarily involves some small contact with the water to satisfy the attraction of young children, while at the same time necessarily avoids significant contact with the water so that serious injury is avoided.

SUMMARY OF THE INVENTION

It is an object of the invention to provide a game which can be played along the coast of a body of water which involves some contact with the water, but which necessarily avoids significant contact with the water which can cause serious injury.

It is a further object of the invention to provide such a beach game whose very object is for the players to avoid getting significantly wet.

It is a further object of the invention to provide such a beach game which is enjoyable by young children and adults as well.

It is a more specific object of the invention to provide such a beach game whose object is for players to chase retreating waves as far out into the retreating surf as possible, and then quickly returning back up the beach without getting significantly wet.

These and other objects of the invention are achieved by a beach game wherein the players walk or run out into the retreating surf of an ocean or lake as far as possible, but without getting wet, to plant a marker into the wet sand. After planting the marker as far out as possible, without getting wet, the player must then return back up the beach faster than the resurgent surf so as to avoid getting wet. In order to determine whether a player has gotten wet, the game is provided with a plurality of water indicator bands which change color upon getting wet. Each player wears a band around a specified body part, such as an ankle, part of the leg, knee or higher body part, depending upon how much contact with the water is desired to be permissible by the players.

The markers which the players plant into the earth are color coded so that individual markers may be identified with individual players. The markers are preferably wooden or plastic poles having a tapered, but not sharp, end which facilitates plantation into the sand. The opposite end of each marker is preferably bulbous shaped to facilitate gripping by the player.

The markers and the water indicator bands are conveniently provided in a carrying pouch with a shoulder strap. The beach game of the invention can provide hours of fun and exercise with minimal contact with the water, and without fear of water injuries. Further details and embodiments of the invention which demonstrate the incredible versatility of the invention will be seen from the following detailed description of the invention in conjunction with the accompanying drawings.

DETAILED DESCRIPTION OF THE INVENTION

Figure 1:
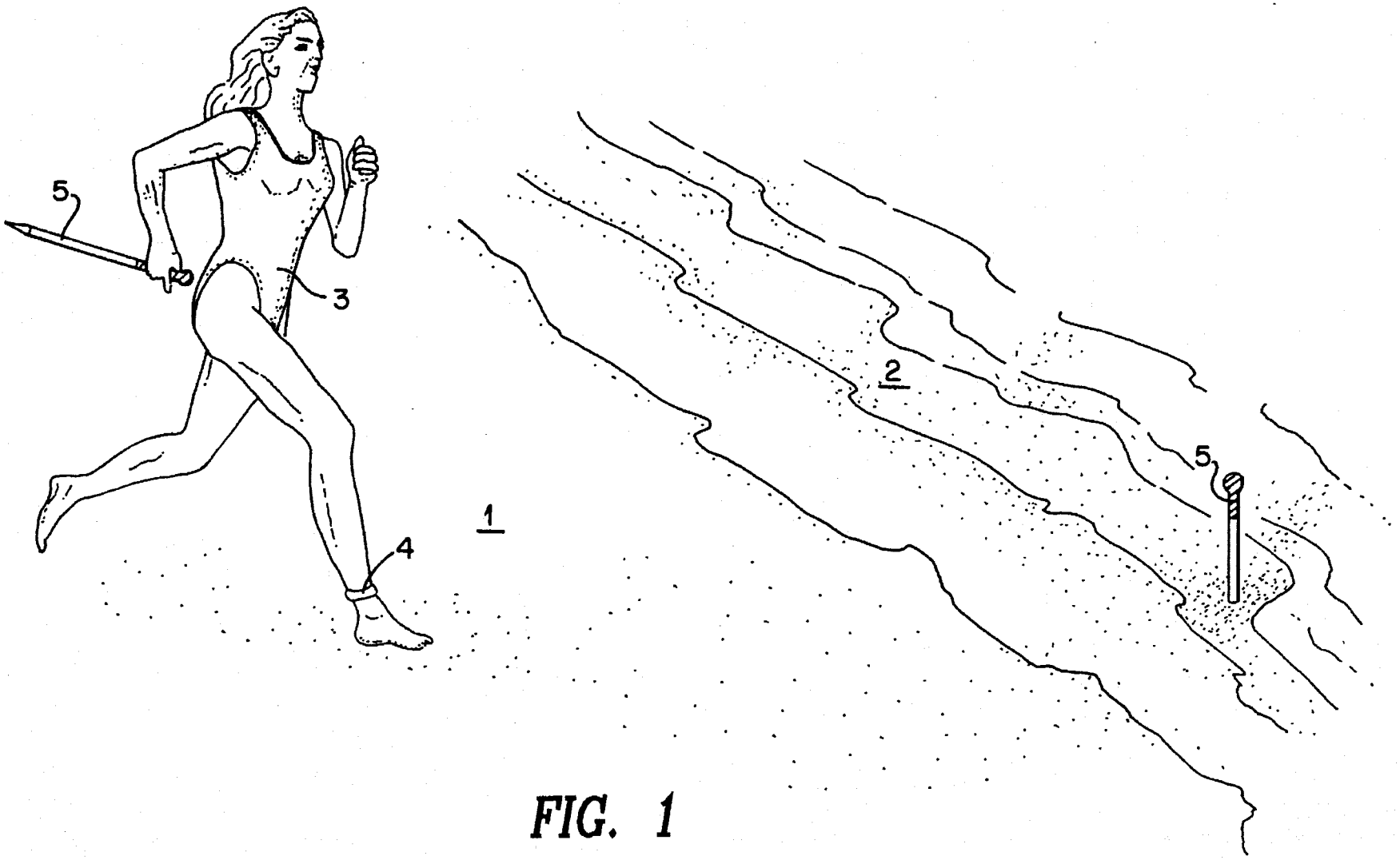
FIG. 1 is a perspective view of a person playing the beach game of the invention.

Referring to FIG. 1, the game of the invention is played on a beach 1 adjacent to a body of water 2 having a surf such as an ocean or lake. A player 3 who wears a water indicator 4 and who carries a marker 5 runs or walks toward the water 2 as the surf retreats. The player goes as far out toward the retreating surf as possible, without wetting the part of the body to which the water indicator 4 is attached. In FIG. 1, the water indicator 4 is worn as an ankle band so that only very little contact with the water will be permitted. This may be desirable when the game is played by young children so that they will not be able to venture very far out into the retreating water waves. However, it will be appreciated that the water indicator 4 may be worn by the players further up on the leg, or perhaps even around the waist or wrist where it is desired to permit more contact with the water. The only limitation is that the water indicator bands 4 be worn at the same position on the body by all players to make the game fair, unless of course it is desired to give one or more players a handicap.

When the player has gone as far out into the retreating surf without getting wet as the player feels is possible, the player then plants the marker 5 into the wet sand to mark the point at which the player stopped progress. At that point, the player must return back up the beach before the resurgent waves wet the player's water indicator 4. If the water indicator 4 indicates that it has become wet, the player is disqualified from that particular game. The object of the game is to plant the marker 5 as far out into the retreating surf as possible, without wetting the water indicator 4.

The game can be played alone for pure exercise and enjoyment, however, preferably there are a plurality of players who compete to plant their markers out as far as possible. The winner of each game is the player who manages to plant marker 5 farthest out into the water, without wetting the water indicator 4 in the process. The game may also be played in sets, such as best three out of five best four out of seven, etc.

At the start of each game, each of the players stands along a straight line drawn in the sand or other marker which serves as a starting line. A non-player, who can serve as a referee, will indicate the start, perhaps vocally or by waving a flag. The players then approach the retreating surf to plant their marker as far out as possible, without wetting the indicator 4, and then return back up the beach as the waves resurge without getting the indicator 4 wet.

Preferably, each game is allotted a certain period of time (e.g., ten minutes). During this time, the players can cautiously try to pace the retreating and resurgent waves to plant their markers out as far as possible. If desired, the rules can permit a player to replant a marker farther out any time during the preset game interval, provided that the player returns back to the starting line before the game time has run out. The game time may be kept by the non-player referee.

The players may also designate a playing field by drawing lines in the sand. If a marker 5 is planted out of bounds, it will not count and the player must replant the marker within bounds within the game time allotted.

In another embodiment, the game is played by the players sequentially, rather than all at the same time. This embodiment is preferred where there is no non-player person to serve as a referee and a time keeper. In this embodiment, each player will be allotted a specified time period (e.g., 10 minutes), within which to plant marker 5 out into the retreating surf as far as possible, again without wetting indicator 4. The time may be monitored by the other players who are awaiting their turn. The player must get back to the starting line before time has expired. Each of the remaining players then takes their respective turns, and after all players have planted their marker 5, it is determined which marker is farthest out from the starting line to determine the winner. As discussed above, if a player wets his color indicator 4 during his turn, that player is disqualified from the particular game being played.

Figure 2:
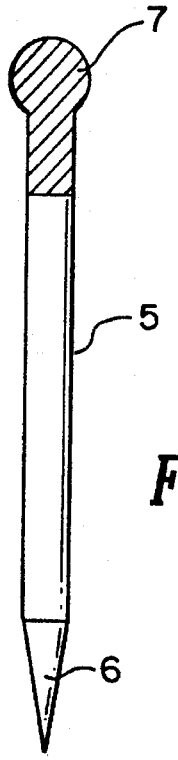
FIG. 2 is a perspective view of a pole marker used in playing the game of the invention.

In order to distinguish the markers 5 of individual players, the game includes a plurality of markers 5 of different colors. Referring to FIG. 2, each marker is preferably a pole having a tapered end 6 for facilitating plantation of the marker into the sand. Preferably, the tapered end 6 is not too sharp to avoid accidental injury. The opposite end of each marker is bulbous shaped 7 for facilitating gripping by the player. It is the bulbous region 7 which is color coded to distinguish the markers of individual players. In lieu of color coding, the markers 5 may be marked with other indicia for distinguishing between different players. For example, the bulbous region 7 of each marker may be designated with a different number or letter. However, color coding is the preferred indicia for distinguishing the markers.

Preferably, each marker 5 is about 3 feet long from end 6 to end 7 so that color coded end 7 will always be visible above the water level after the marker 5 is planted. The tapered end 6 is preferably about 4 inches in length from the point where it begins to taper until the terminal point. The markers 5 are preferably wooden, however, they may be constructed of other sturdy materials such as plastic.

Figure 3:
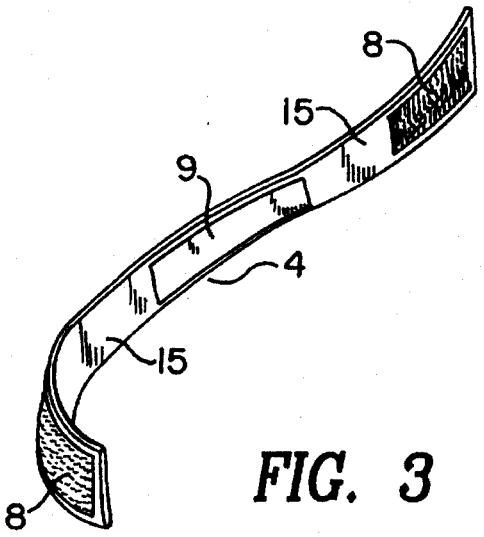
FIG. 3 is a perspective view of a water indicator leg band in the open position, which is worn by players of the beach game to indicate whether a player has become wet.

Referring to FIG. 3, a water indicator 4 is generally illustrated in the open position. Indicator 4 may be a leg band, an ankle band (as illustrated in FIG. 1), a waist band, or even a wrist band, depending upon how much permissible contact with the water is desired. The indicator 4 includes VELCRO® strips 8 for attachment of the indicator to the player and preferably include an elastic section 15 for permitting a snug fit to the player. Alternatively, other attachment means for closing the band around the player may be provided such as an adjustable buckle (not illustrated).

The indicator band 4 includes a color-changing patch 9 for indicating when contact with water has been made. A variety of color changing and color indicating materials well known may be used for the patch 9. These materials will change color upon being contacted with water to indicate that the player should be disqualified from the particular game at hand. The materials used will preferably return back to their original color once the water has evaporated so that the color indicator 4 may be reused in a new game. Alternatively, the game may be provided with a supply of disposable water indicators which are used only once. Disposable water indicators are preferably constructed of a paper band with adhesive tape ends and a patch of the color indicating material in the central region.

Figure 4:
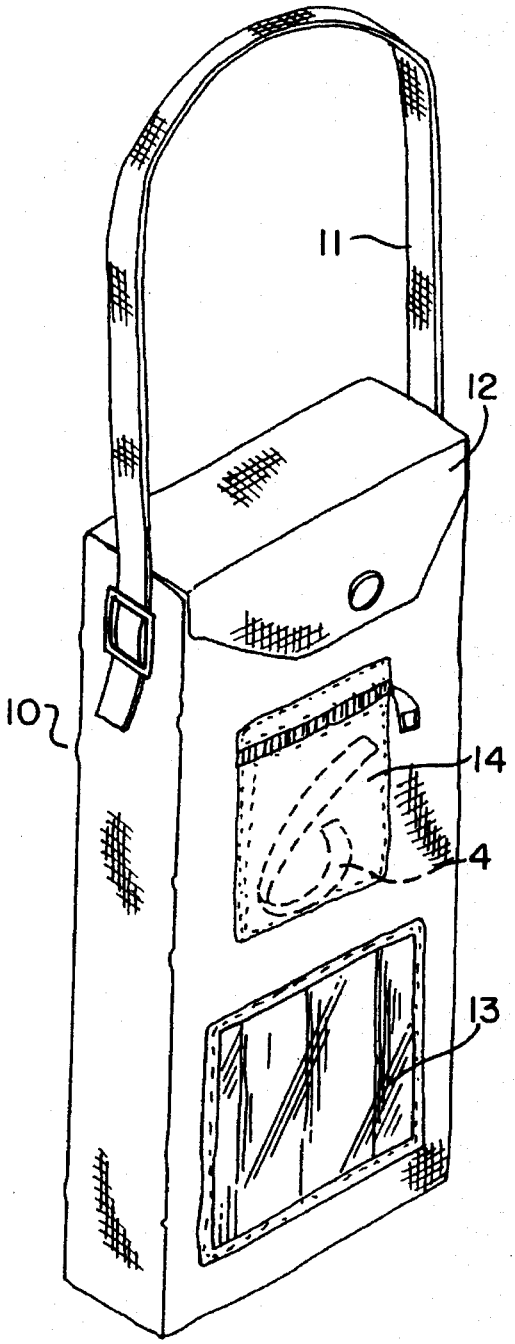
FIG. 4 is a perspective view of a carrying pouch holding the parts and accessories of the beach game of the invention.

Referring to FIG. 4, a carrying pouch for holding the game accessories is generally illustrated at 10. The carrying pouch includes a shoulder strap 11 and a flap 12 which can be opened to allow access to the interior of the pouch. The markers 5 are vertically disposed inside the pouch 10. For this purpose, the pouch 10 has an elongated configuration. If desired, a transparent plastic window 13 may be provided to enable persons to see the contents of the pouch. The water indicator bands 4 may be kept in a front compartment 14 in the carrying pouch 10.

If desired, the beach game of the invention may also be equipped with a directional indicator, such as an arrow, which can be placed on the sand to indicate the direction in which the players should pursue the retreating surf to plant their markers 5. For example, on any given day, a particular tide or current may cause the surf to generally retreat and resurge in a particular direction, and it would be desirable to play the game along that particular direction. The arrow or other directional marker can serve as a reminder to guide the players in said direction.

A preferred beach game kit includes a set of four markers 5, each coded with a different color in the bulbous region 7, and four elastic water indicator bands 4, contained in carrying pouch 10. Optionally, the elastic portion 15 of each band 4 may also be color coded to correspond to the color coding on the markers 5. This has the advantage of ensuring that each player remembers which marker is his, after all the markers have been planted in the water.

Thus, it can be seen that the beach game of the invention can provide for hours of enjoyment and exercise with minimal contact with the water. The game is particularly advantageous for parents with young children who are unable to swim, as the children will necessarily avoid significant contact with the water while playing the game so as not to be disqualified. By placing the water indicator bands 4 around the ankle of each player, children will be dissuaded from even immersing their feet in the water. However, the game is versatile because by wearing the water indicator bands higher up on the body, greater permissible water contact will be afforded.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are accordingly to be regarded in an illustrative rather than a restrictive sense.

What is claimed is:

1. A beach game comprising:

a plurality of poles, each pole having a first end which is adapted to be implantable in sand and a second end which is configured to be grippable by a person's hand; and a plurality of water indicators, each water indicator including means for attaching the water indicator to a person and a material which provides indication of contact of the material with water when the material contacts water.

2. The game according to claim 1, wherein the end of the pole which is adapted to be implantable in sand is tapered to a point.

3. The game according to claim 2, wherein the end of the pole which is configured to be grippable by a person includes a bulbous region.

4. The game according to claim 1, wherein the end of the pole which is configured to be grippable by a person includes a bulbous region.

5. The game according to claim 1, wherein each pole includes indicia which distinguishes each pole from other poles.

6. The game according to claim 5, wherein said indicia is a color.

7. The game according to claim 6, wherein the end of each pole which is configured to be grippable by a person has a distinctive color.

8. The game according to claim 1, wherein the material of the water indicator changes color from a first color to a second color upon making contact with water.

9. The game according to claim 8, wherein the material of the water indicator in a wet state changes color from said second color back to said first color upon drying.

10. The game according to claim 1, wherein the water indicator is in the form of an elastic band.

11. The game according to claim 1, further comprising a directional indicator.

12. The game according to claim 1, further comprising a carrying pouch which holds the poles and the water indicators.

13. A method of playing a game on a beach which is adjacent to a body of water having a surf, comprising the steps of:

attaching a water indicator to a player, said water indicator including a material which provides an indication upon becoming wet; providing said player with a pole which is configured to be implantable in sand; said player pursuing retreating surf in a direction toward the body of water while avoiding wetting said water indicator; said player planting said pole into the beach near the surf while avoiding wetting said water indicator; and said player then moving away from the body of water while avoiding wetting said water indicator.

14. The method according to claim 13, wherein the pole which is configured to be implantable in sand is tapered to a point at one end thereof.

15. The method according to claim 14, wherein the pole includes a second end which includes a bulbous region.

16. The method according to claim 13, wherein the material on the water indicator changes color from a first color to a second color upon making contact with water.

17. The method according to claim 16, wherein the material on the water indicator in a wet state changes color from said second color back to said first color upon drying.

18. The method according to claim 13, wherein the water indicator is in the form of an elastic band.

19. The method according to claim 18, wherein the water indicator is attached around an ankle of the player.

* * * * *